US011634201B1

(12) United States Patent
Waisanen et al.

(10) Patent No.: US 11,634,201 B1
(45) Date of Patent: Apr. 25, 2023

(54) MARINE DRIVES AND IDLE RELIEF EXHAUST SYSTEMS FOR MARINE DRIVES

(71) Applicant: Brunswick Corporation, Mettawa, IL (US)

(72) Inventors: Andrew S. Waisanen, Fond du Lac, WI (US); Jong Hoe Huh, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 169 days.

(21) Appl. No.: 17/165,284

(22) Filed: Feb. 2, 2021

(51) Int. Cl.

| | |
|---|---|
| ***B63H 20/24*** | (2006.01) |
| ***F01N 13/12*** | (2010.01) |
| ***F01N 13/00*** | (2010.01) |
| ***F01N 1/16*** | (2006.01) |
| ***F01N 13/04*** | (2010.01) |

(52) U.S. Cl.
CPC ..... *B63H 20/245* (2013.01); *F01N 1/166* (2013.01); *F01N 13/004* (2013.01); *F01N 13/04* (2013.01); *F01N 13/12* (2013.01); *F01N 2590/021* (2013.01)

(58) Field of Classification Search
CPC ..... B63H 20/245; F01N 1/166; F01N 13/004; F01N 13/04; F01N 13/12; F01N 2590/021; F01N 13/02
See application file for complete search history.

(56) References Cited

U.S. PATENT DOCUMENTS

| | | | | |
|---|---|---|---|---|
| 6,273,771 | B1 | 8/2001 | Buckley et al. | |
| 6,409,557 | B1 * | 6/2002 | Tsunekawa | B63H 20/245 440/89 R |
| 9,359,981 | B1 | 6/2016 | Waisanen et al. | |
| 9,376,194 | B1 | 6/2016 | Jensen et al. | |
| 9,376,195 | B1 * | 6/2016 | Jaszewski | B63H 20/245 |
| 9,784,218 | B1 | 10/2017 | Waisanen | |
| 9,909,545 | B1 | 3/2018 | Waisanen et al. | |
| 9,944,376 | B1 | 4/2018 | Waisanen et al. | |
| 9,969,475 | B1 | 5/2018 | Waisanen | |
| 10,180,121 | B1 | 1/2019 | Waisanen et al. | |
| 10,239,599 | B1 | 3/2019 | Biel et al. | |
| 10,414,478 | B1 | 9/2019 | Waisanen et al. | |
| 10,556,658 | B1 | 2/2020 | Frost et al. | |
| 10,724,410 | B1 | 7/2020 | Waisanen | |
| 10,800,502 | B1 | 10/2020 | Alby et al. | |
| 2005/0279571 | A1 * | 12/2005 | Marocco | F01N 13/009 181/270 |

* cited by examiner

*Primary Examiner* — Andrew Polay
(74) *Attorney, Agent, or Firm* — Andrus Intellectual Property Law, LLP

(57) ABSTRACT

A marine drive is configured to propel a marine vessel in a body of water. The marine drive has an engine; a primary exhaust conduit receiving exhaust gases from the engine and discharging the exhaust gases to a primary exhaust outlet discharging the exhaust gases to the body of water; an idle relief exhaust outlet discharging exhaust gases to atmosphere, above the body of water; a primary idle relief muffler receiving exhaust gases from the primary exhaust conduit; a secondary idle relief muffler receiving exhaust gases from the primary idle relief muffler; and a tertiary idle relief muffler configured to receive exhaust gases from the secondary idle relief muffler and discharges exhaust gases to atmosphere via the idle relief exhaust outlet.

24 Claims, 9 Drawing Sheets

MARINE DRIVES AND IDLE RELIEF EXHAUST SYSTEMS FOR MARINE DRIVES

FIELD

The present disclosure relates to marine drives and more particularly to idle relief exhaust systems for marine drives.

BACKGROUND

The following U.S. Patents are incorporated herein by reference:

U.S. Pat. No. 6,273,771 discloses a control system for a marine vessel that incorporates a marine propulsion system that can be attached to the marine vessel and connected in signal communication with a serial communication bus and a controller. A plurality of input devices and output devices are also connected in signal communication with the communication bus. A bus access manager, such as a CAN Kingdom network, is connected in signal communication with the controller to regulate the incorporation of additional devices to the plurality of devices in signal communication with the bus. The controller is connected in signal communication with each of the plurality of devices on the communication bus. The input and output devices can each transmit messages to the serial communication bus for receipt by other devices.

U.S. Pat. No. 9,376,195 discloses an outboard motor having an engine with an exhaust gas discharge opening, a midsection housing coupled below and supporting the engine, and an exhaust pipe having an exhaust inlet in fluid communication with the exhaust gas discharge opening. The exhaust pipe extends downwardly to a primary exhaust outlet. An idle relief port in the exhaust pipe is in a fluid path between the exhaust inlet and the primary exhaust outlet. A sound-attenuating plenum chamber has an interior that is in fluid communication with an interior of the exhaust pipe by way of the idle relief port. The plenum chamber is a separate component that is exterior to the midsection housing, and exhaust gas flows from the interior of the exhaust pipe to the interior of the plenum chamber without first flowing through the midsection housing.

U.S. Pat. No. 9,944,376 discloses exhaust systems for outboard marine engines that are configured to propel a marine vessel in a body of water. An intermediate exhaust conduit is configured to receive the exhaust gas from the primary exhaust conduit. A primary muffler receives the exhaust gas from an intermediate exhaust conduit. A secondary muffler receives the exhaust gas from the primary muffler. An idle relief outlet discharges the exhaust gas from the secondary muffler to atmosphere. A bypass valve is positionable into an open position wherein the exhaust gas is permitted to bypass the secondary muffler and flow from the primary muffler to the idle relief outlet and into a closed position wherein the exhaust gas is not permitted to bypass the secondary muffler and instead flows from the primary muffler to the idle relief outlet via the secondary muffler.

U.S. Pat. No. 9,969,475 discloses a system for mounting an outboard motor propulsion unit to a marine vessel transom including a support cradle having a head section coupled to a transom bracket and a pair of arms extending aftward from the head section and along opposite port and starboard sides of the propulsion unit. A pair of upper mounts is provided, each upper mount in the pair coupling a respective arm to the propulsion unit aft of a center of gravity of an engine system of the propulsion unit. A pair of lower mounts is also provided, each lower mount in the pair coupling the propulsion unit to the transom bracket. The pair of upper mounts is located aft of the pair of lower mounts when the propulsion unit is in a neutral position, in which the propulsion unit is generally vertically upright and not tilted or trimmed with respect to the transom.

U.S. Pat. No. 10,556,658 discloses a marine drive having an engine; an exhaust conduit that conveys exhaust gases from the engine to an idle relief outlet on the marine drive, wherein the idle relief outlet discharges the exhaust gases to atmosphere when the marine drive is operated at an idle speed; and an idle relief muffler having a muffler inlet that receives the exhaust gases from the exhaust conduit, a muffler outlet that discharges the exhaust gases to the idle relief exhaust outlet, and a drain for draining water from the idle relief muffler. The muffler inlet conveys exhaust gases into the idle relief muffler in a direction that is oriented away from the muffler outlet and away from the drain, such that water in the exhaust gases is encouraged to separate from the exhaust gases and then drain from the idle relief muffler via the drain.

U.S. Pat. No. 10,800,502 discloses an outboard motor having a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A marine drive is configured to propel a marine vessel in a body of water. The marine drive has an engine; a primary exhaust conduit receiving exhaust gases from the engine and discharging the exhaust gases to a primary exhaust outlet discharging the exhaust gases to the body of water; an idle relief exhaust outlet discharging exhaust gases to atmosphere, above the body of water; a primary idle relief muffler receiving exhaust gases from the primary exhaust conduit; a secondary idle relief muffler receiving exhaust gases from the primary idle relief muffler; and a tertiary idle relief muffler configured to receive exhaust gases from the secondary idle relief muffler and discharge exhaust gases to atmosphere via the idle relief exhaust outlet.

Various other features, objects, and advantages of the invention will be made apparent from the following description taken together with the drawings.

BRIEF DESCRIPTION OF THE DRAWINGS

The present disclosure includes the following Figures.

DETAILED DESCRIPTION

During research and development, the present inventors realized design challenges related to the prior art, and particularly prior art that teaches idle relief exhaust systems for outboard motors having primary and secondary idle relief mufflers. For example, the present inventors realized there is often limited space available and thus limited muffler volume available in the midsection of the outboard motor, below the pass-through plate. This can lead to unacceptable limits on muffler performance. The inventors also realized that location of the bottom portion of the mufflers relative to the idle relief outlet port can cause a large section of the muffler volume to fill with water, leading to unsatisfactory muffler performance and a potential for water discharge via the idle relief outlet port. The present inventors also realized that size constraints in the midsection of the outboard motor sometimes limit the opportunity to use water separating features, for example as disclosed in U.S. Pat. No. 10,556,658. The concepts in the present disclosure were conceived based upon on the present inventors' recognition of these and other issues with the prior art.

Figure 1:
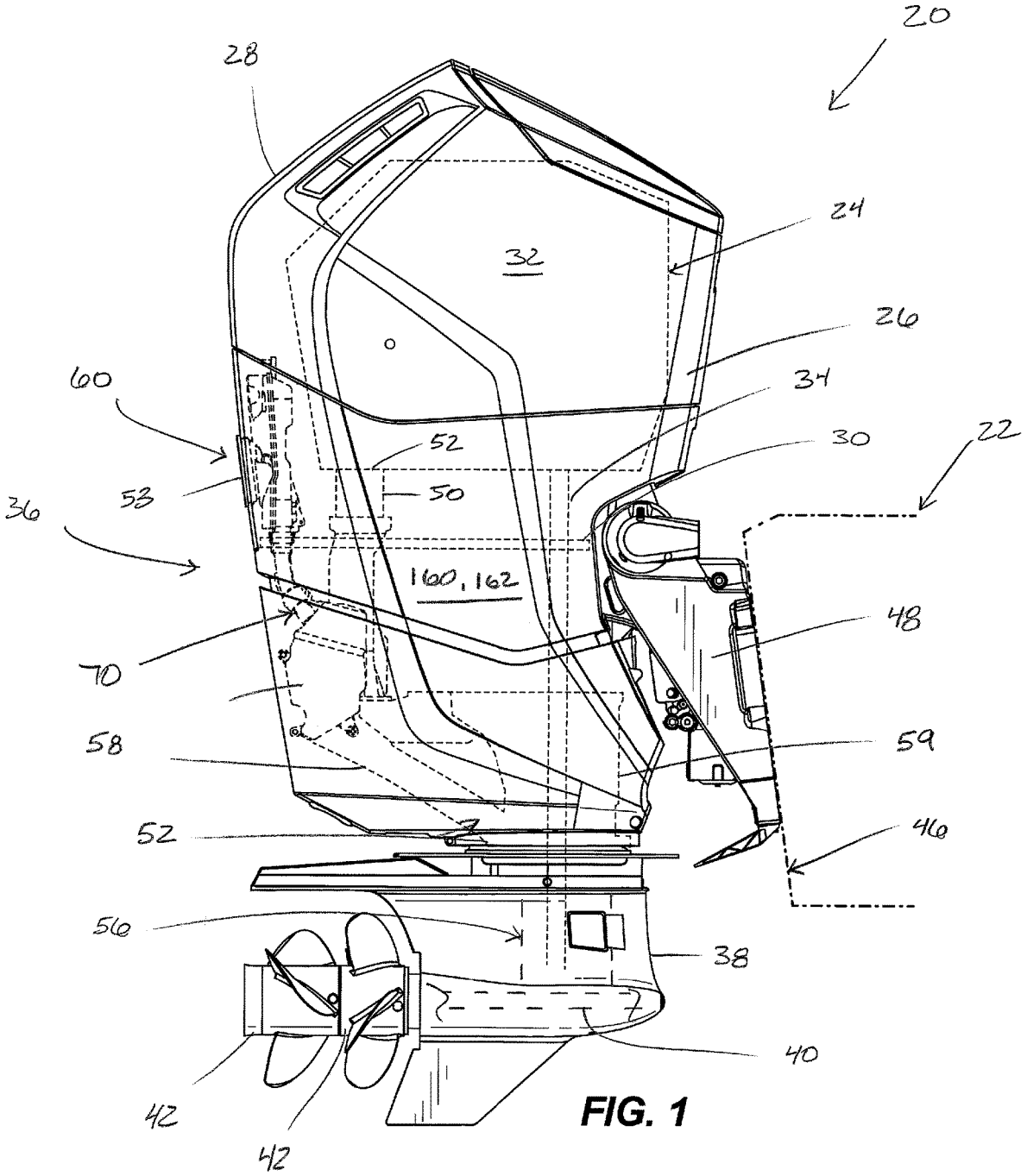
FIG. 1 is a side view of a marine drive configured to propel a marine vessel in a body of water, the marine drive being shown in solid lines and the marine vessel being shown in dash-and-dot lines.

FIG. 1 depicts an outboard motor 20 for propelling a marine vessel 22 in a body of water. The outboard motor 20 has a powerhead 24 located in a powerhead compartment 26 defined between a top cowl 28 and a pass-through plate 30. The powerhead 24 comprises among other things a combustion engine 32, operation of which causes rotation of a driveshaft 34 that extends downwardly into a midsection 36 of the outboard motor 20. The driveshaft 34 is in operative engagement with one or more propeller shafts 40 extending from a lower gearcase 38 located below the midsection 36. Rotation of the driveshaft 34 causes rotation of the propeller shaft(s) 40, which in turn causes rotation of one or more propellers 42. The midsection 36 is defined between the pass-through plate 30 and the top of the lower gearcase 38. The outboard motor 20 is coupled to the stern 46 of the marine vessel 22 by a transom bracket 48. In the illustrated example, the lower gearcase 38 is steerable relative to the midsection 36, as disclosed in U.S. Pat. No. 10,800,502. The outboard motor 20 shown in the drawings is exemplary only, and the concepts of the present disclosure are equally applicable to other types of marine drives known in the art.

The outboard motor 20 has a novel exhaust system 70 for discharging exhaust gases from the engine 32 to the body of water in which the outboard motor 20 is operated, as well as to atmosphere during for example idle and low speed operations. A primary exhaust conduit 50 has an upstream end 52 coupled to the engine 32 and a downstream end 54 extending into or through the midsection 36 to the lower gearcase 38. The upstream end 52 receives exhaust gases from the engine 32 and the downstream end 54 is configured to discharge the exhaust gases via a primary exhaust outlet, shown schematically at 56, on the lower gearcase 38 for discharging the exhaust gases to the surrounding body of water. In the illustrated example, the primary exhaust conduit 50 includes an exhaust conduit portion 58 on a steering housing 59 of the outboard motor 20, which in turn is coupled to the noted primary exhaust outlet 56 via the downstream end 54. Reference is made to U.S. Pat. No. 10,800,502 for further description of the steering housing 59 and the primary exhaust conduit 50 including how exhaust conduit portion 58 passes the exhaust gases annularly around the driveshaft 34 at an intersection between the midsection 36 and lower gearcase 38 and then into the lower gearcase 38. The primary exhaust outlet 56 is in the lower gearcase 38 and passes the exhaust gases from the noted primary exhaust conduit 50 through the hub of the propellers 42 to the surrounding body of water. The primary exhaust conduit 50 including the exhaust conduit portion 58, as shown in the drawings, are exemplary only. The concepts of the present disclosure are equally applicable to many other configurations of exhaust conduits and related components for discharging exhaust gases.

The exhaust system 70 has an idle relief exhaust outlet 60 that discharges an idle relief portion of the exhaust gases to atmosphere, above the body of water, particularly when the outboard motor 20 is operated at idle and low speeds. The idle relief exhaust outlet 60 includes a grommet 53 mounted in a rear portion of the cowling on the midsection 36, above the pass-through plate 30. In the illustrated example, the grommet 53 is oriented downwardly, for example via louvers, to reduce intake of water into the exhaust system 70. Reference is made to U.S. Pat. No. 10,556,658 for further description of an exemplary grommet 53. The location and configuration of the idle relief exhaust outlet 60 is exemplary only and the concepts of the present disclosure are equally applicable to many other types of idle relief exhaust outlets 60, some of which are disclosed in the above-incorporated U.S. patents.

Figure 2:
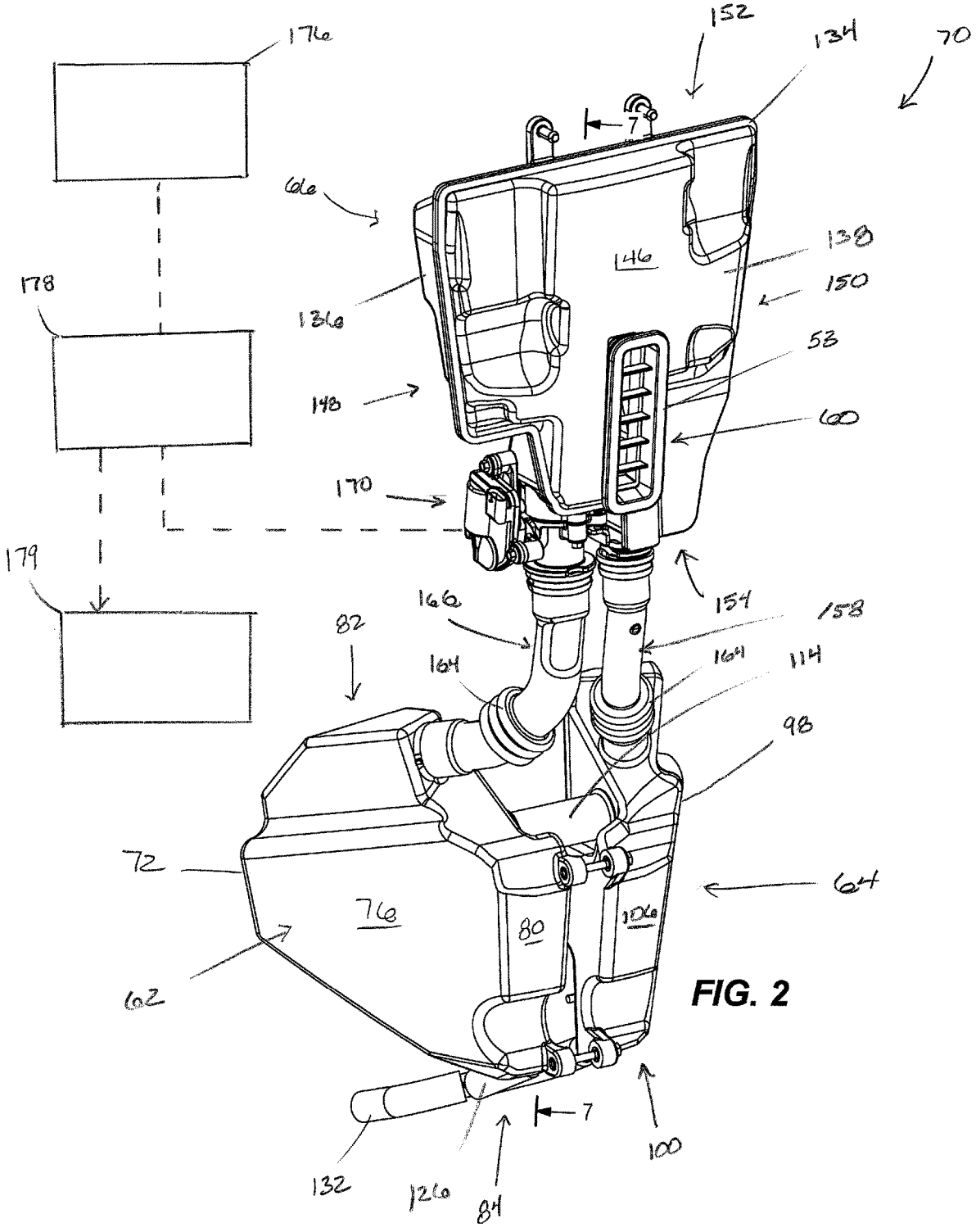
FIG. 2 is a perspective view of an exhaust system for the marine drive, the exhaust system having primary, secondary, and tertiary idle relief mufflers.
Figure 3:
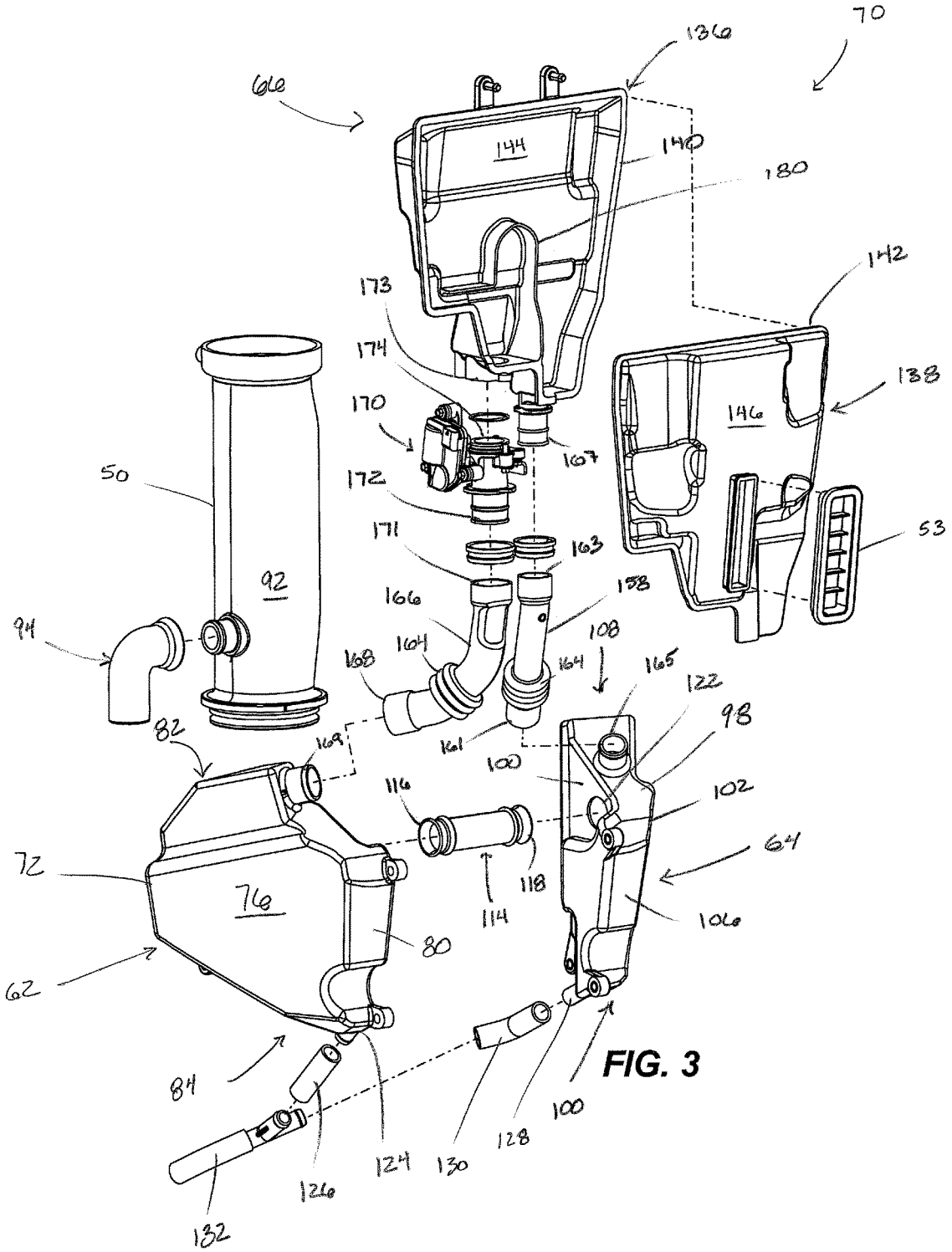
FIG. 3 is an exploded view of the exhaust system shown in FIG. 2.
Figure 4:
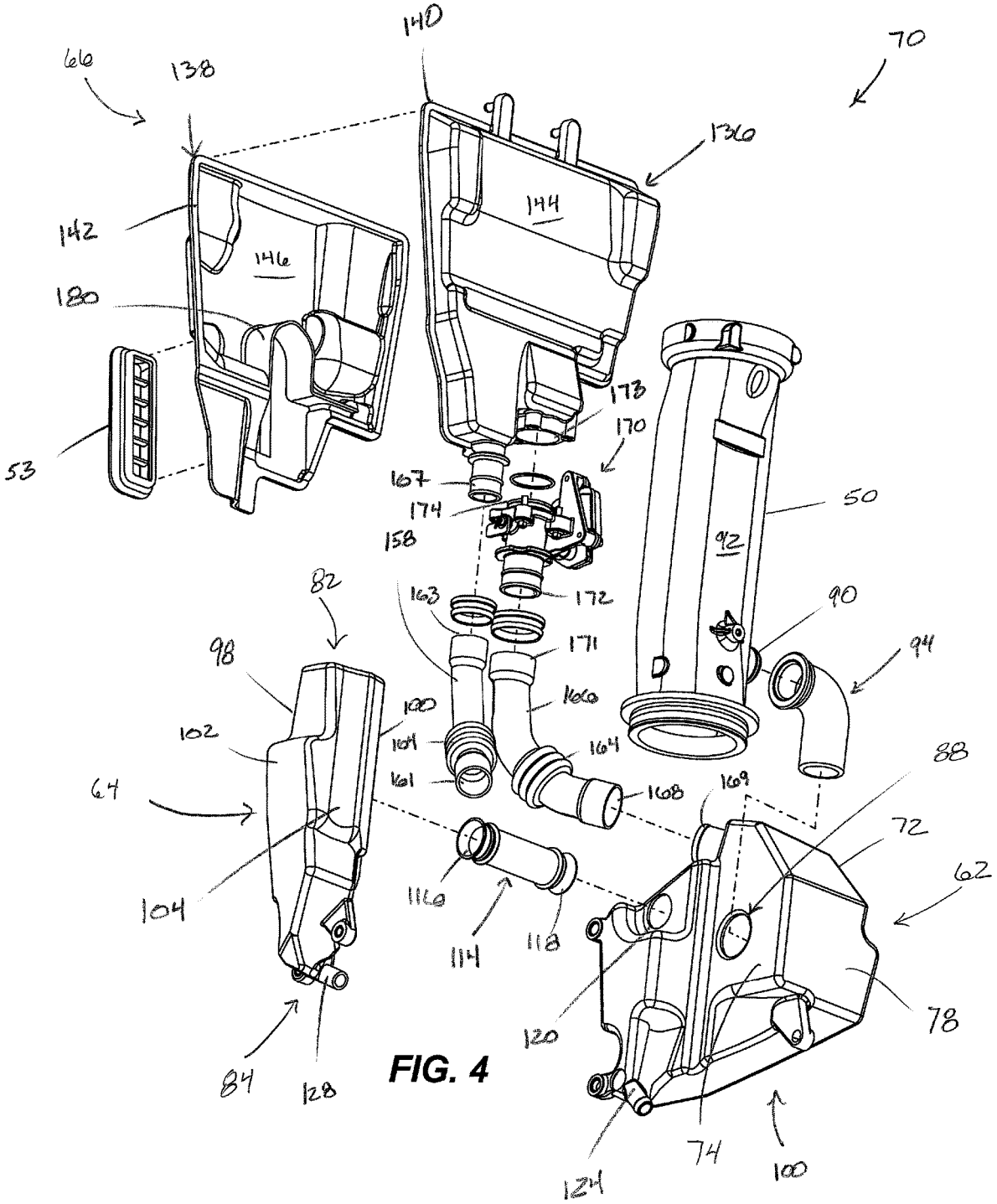
FIG. 4 is an opposing exploded view of the exhaust system shown in FIG. 2.

As shown in FIGS. 2-4, the exhaust system 70 further includes a primary idle relief muffler 62, a secondary idle relief muffler 64, and a tertiary idle relief muffler 66. The primary and secondary mufflers 62, 64 are in the midsection 36 and the tertiary muffler 66 is above the pass-through plate 30, in the powerhead compartment 26. However, this is not intended to be limiting and the location of these components could vary from what is shown. As will be further described herein below, the primary muffler 62 receives exhaust gases from the primary exhaust conduit 50. In certain operational states and embodiments, the secondary muffler 64 receives all or a portion of the exhaust gases from the primary muffler 62. In certain operational states and embodiments, the tertiary muffler 66 receives exhaust gases from the primary muffler 62. In certain operational states and embodiments, the tertiary muffler 66 receives exhaust gases from the primary muffler 62 via the secondary muffler 64. The tertiary muffler 66 is configured to discharge exhaust gases to atmosphere via the idle relief exhaust outlet 60.

Figure 7:
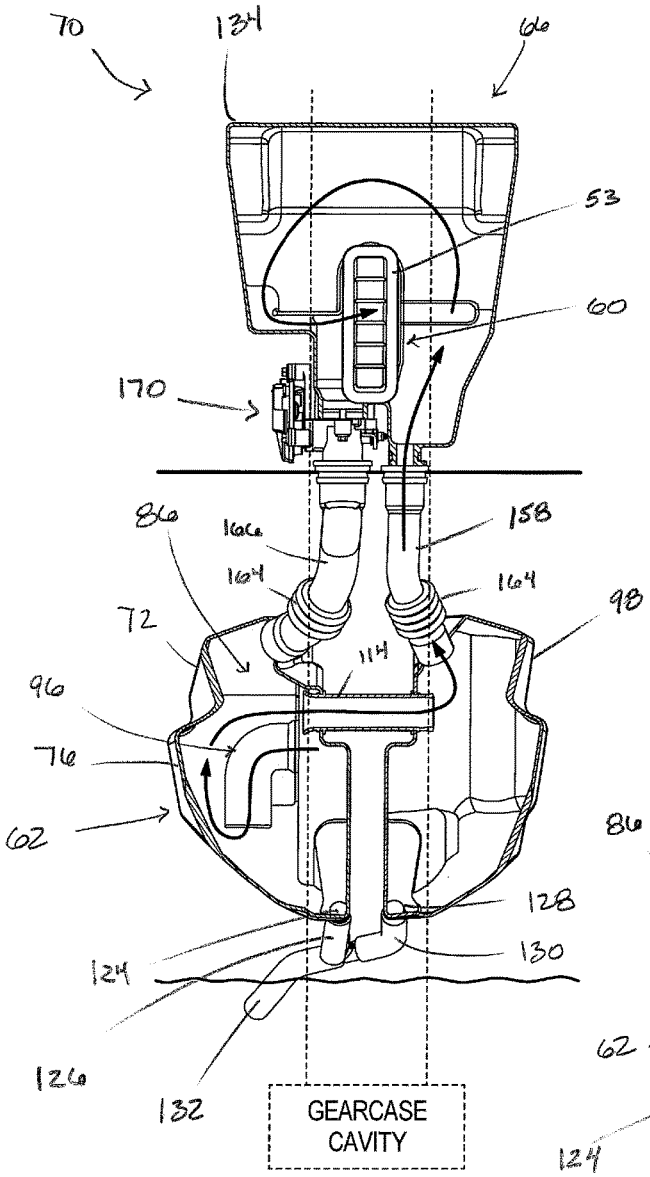
FIG. 7 depicts flow of exhaust gases through the exhaust system during quiet mode, including through the primary, secondary, and tertiary idle relief mufflers.

Referring to FIGS. 2-4, the primary muffler 62 includes an oblong housing 72 having inner and outer sidewalls 74, 76, front and back end walls 78, 80, and a top 82 and bottom 84. The outer sidewall 76 curves outwardly and then back inwardly from the top 82 to the bottom 84. Briefly referring to FIGS. 7 and 8, the housing 72 has an open interior 86 that allows for expansion of the exhaust gases flowing therethrough and attenuation of noise associated with the exhaust gases. The shape and/or size of the interior 86 is "tuned", or in other words specifically shaped and sized to attenuate certain ranges of frequencies associated with the noted exhaust noise. As shown in FIG. 4, an inlet opening 88 is formed through the inner sidewall 74 for receiving the noted idle portion of the exhaust gases from an outlet opening 90 formed in the sidewall 92 of the primary exhaust conduit 50, between the upstream and downstream ends 52, 54, via an elbow conduit 94. As shown in FIG. 7, an inlet boss 96 redirects the lateral flow of exhaust gases into the interior 86, downwardly towards the curved interior surface of the outer sidewall 76, thus promoting separation of water from the exhaust gases, for example as disclosed in U.S. Pat. No. 10,556,658.

Referring to FIGS. 2-4, the secondary muffler 64 includes an oblong housing 98 having inner and outer sidewalls 100, 102, front and back end walls 104, 106, and a top 108 and bottom 110. The outer side wall 102 curves outwardly and then back inwardly from the top 108 to the bottom 110. Briefly referring to FIGS. 7 and 8, the housing 98 has a generally open interior 112 that allows for expansion of the exhaust gases flowing therethrough and attenuation of noise associated with the exhaust gases. The shape and/or size of the interior 112 is "tuned" or in other words specifically sized and shaped to attenuate certain ranges of frequencies associated with the noted exhaust noise.

As shown in FIGS. 2-4, 7 and 8, a cross-over conduit 114 conveys exhaust gases from the primary muffler 62 to the secondary muffler 64. The cross-over conduit 114 has opposing first and second ends 116, 118. The first end 116 protrudes into the interior 86 of the primary muffler 62 via an opening 120 formed through an upper portion of the inner sidewall 76. The second end 118 protrudes into the interior 112 of the secondary muffler 64 via an opening 122 formed through an upper portion of the inner sidewall 100. The length and diameter of the cross-over conduit 114 and/or the length and diameter of the cross-over conduit 114 that protrudes into the interiors 86, 112 can be "tuned" or in other words specifically sized and shaped to attenuate certain ranges of frequencies associated with the noted exhaust noise.

Referring to FIG. 3, a primary drain 124 is configured to gravity drain water that separates from the exhaust gases in the primary muffler 62. The primary drain 124 includes a through-bore formed through the bottom 84 of the oblong housing 72, which drains by gravity to a first drain conduit 126. A secondary drain 128 is configured to gravity drain water that separates from the exhaust gases in the secondary muffler 64. The secondary drain 128 includes a through-bore formed through the bottom 110 of the housing 98, which drains by gravity to a second drain conduit 130. The first and second drain conduits 126 and 130 are merged in a Y-fitting to a third drain conduit 132, which directly or indirectly discharges the water from the outboard motor 20 to the surrounding body of water, for example via the lower gearcase 38. The type and configuration of the primary and secondary drains 124, 128 can vary from what is shown, as will become evident from the description herein below regarding the alternate embodiment of FIGS. 9-11.

Referring to FIGS. 2-6, the tertiary muffler 66 includes a clamshell housing 134 having front and back housing portions 136, 138 that are fastened together along perimeter flanges 140, 142. The front housing portion 136 has an end wall 144 and the back housing portion 138 has an end wall 146. The clamshell housing 134 extends from side 148 to opposite side 150, and from top 152 to bottom 154. The shape and/or size of the clamshell housing 134 is "tuned" or in other words specifically sized and shaped to attenuate certain ranges of frequencies associated with the noted exhaust noise.

A first conduit 158 conveys exhaust gases from the secondary muffler 64 to the tertiary muffler 66. The first conduit 158 extends through the pass-through plate 30. The first conduit 158 has a first end 161 coupled to a through-bore 165 extending through the top 108 of the secondary muffler 64 and an opposite, second end 163 coupled to a through-bore 167 extending through the bottom 154 of the tertiary muffler 66, particularly through the bottom of the front housing portion 136. The through-bore 167 is also located at a lowest point on the tertiary muffler 66 to as to efficiently gravity drain water from the tertiary muffler 66 to the secondary muffler 64, via the first conduit 158, for discharge via the secondary drain 128, as described herein above.

A second (bypass) conduit 166 conveys a portion of the exhaust gases from the primary muffler 62 to the tertiary muffler 66, without traveling through the secondary muffler 64 via the cross-over conduit 114 and first conduit 158. As shown in FIG. 1, the second conduit 166 extends through the pass-through plate 30. The second conduit 166 has a first end 168 coupled to a through-bore 169 extending through the top 82 of the primary muffler 62, and an opposite, second end 171 coupled to a bypass valve 170. The bypass valve 170 has a first end 172 coupled to the second end 171 of the second conduit 166 and an opposite, second end 174 coupled to a through-bore 173 extending through the bottom 154 of the tertiary muffler 66, particularly through the bottom of the front housing portion 136. The bypass valve 170 is movable into and between an open position in which exhaust gases are permitted to flow through the second conduit 166 and a closed position in which the exhaust gases are inhibited (including but not limited to totally prevented) from flowing from the primary muffler 62 to the tertiary muffler 66 via the second conduit 166. In a non-limiting example, the bypass valve 170 is a conventional butterfly valve assembly available for purchase from Mercury Marine, part number 8M0132670. The through-bore 173 is also located at a lowest point on the tertiary muffler 66 to as to efficiently gravity drain water from the tertiary muffler 66 to the primary muffler 62, via the second conduit 166, for discharge via the primary drain 124, as described herein above.

Optionally as further explained herein below, movement of the bypass valve 170 is controllable via a user input device 176 and/or a controller 178.

Figure 6:
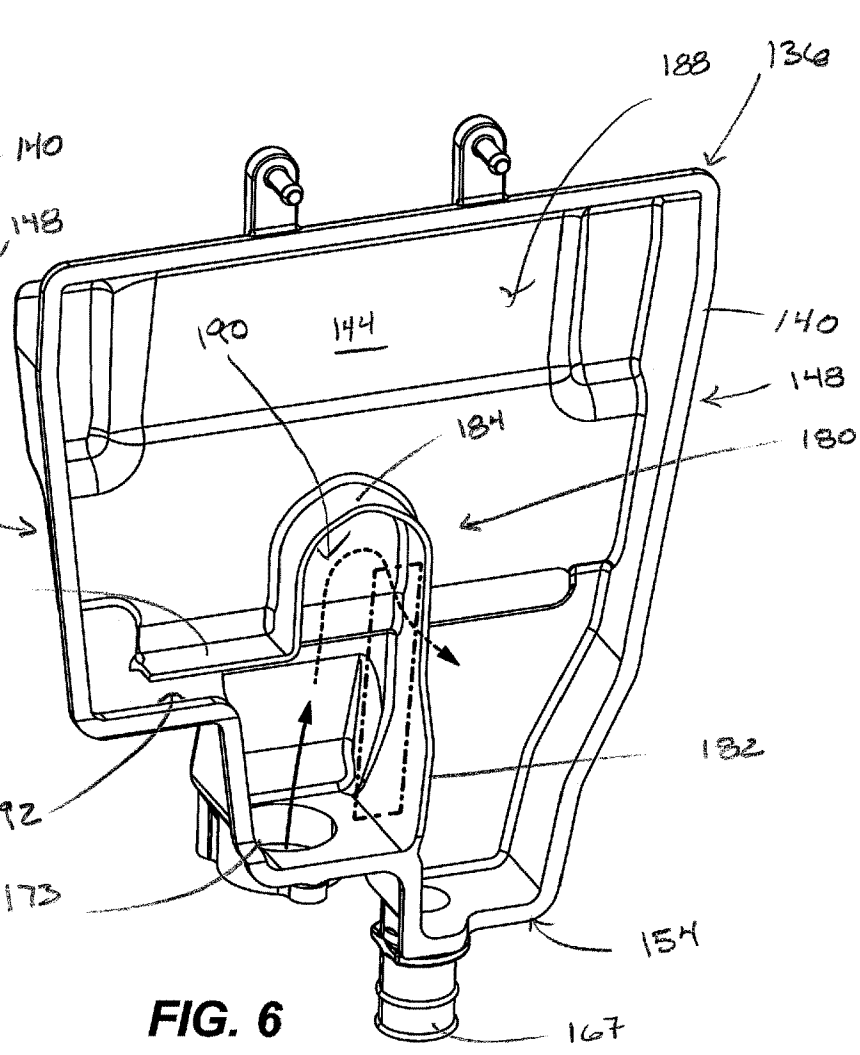
FIG. 6 depicts flow of exhaust gases through the tertiary idle relief muffler during a louder, sport mode, including through the smaller chamber without going through the large chamber.
Figure 5:
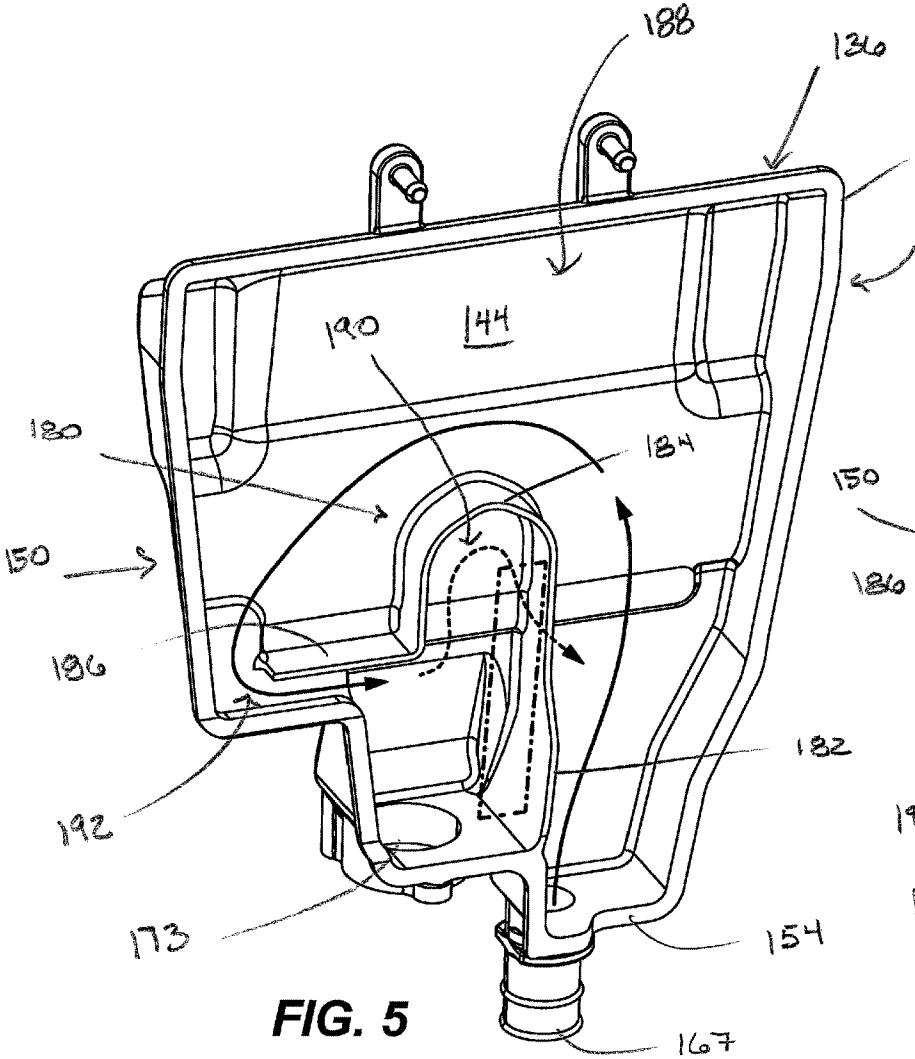
FIG. 5 depicts flow of exhaust gases through the tertiary idle relief muffler during a quiet mode, including through large and smaller chambers.

Referring to FIGS. 5 and 6, the tertiary muffler 66 has an internal wall 180 that extends inwardly from the end walls 144, 146 of the front and back housing portions 136, 138. The internal wall 180 has a lower portion 182 that extends upwardly from the bottom 154 to a curved top portion 184, which leads to a lateral wall portion 186 that extends towards the side 150. A large chamber 188 is between one side of the internal wall 180 and the perimeter flanges 140, 142. A relatively smaller chamber 190 is defined between the opposite side of the internal wall 180, within the curved top portion 184, and the bottom 154. An elongated narrow channel 192 connects the large chamber 188 to the smaller chamber 190 and is defined between the lateral wall portion 186 and the bottom 154. As further explained herein below, during certain operational states of the exhaust system 70, and as shown by solid line arrows in FIG. 5, the large chamber 188 receives exhaust gases from the secondary muffler 64 via the first conduit 158 and directs the exhaust gases to the channel 192. As shown by dash-and-dot arrow in FIG. 5, the exhaust gases are directed from the elongated channel 192 to the smaller chamber 190 and then transversely through an outlet opening 194 formed through the end wall 144 of the front housing portion 136, for subsequent discharge from the outboard motor 20 via the idle relief exhaust outlet 60. As further explained herein below, during certain operational states of the exhaust system 70, exhaust gases are supplied directly to the smaller chamber 190, via the second conduit 166 and through-bore 173, for discharge via the outlet opening 194 and idle relief exhaust outlet 60.

Referring now to FIG. 1, the outboard motor 20 has a driveshaft housing generally located at 160 through which the noted driveshaft 34 extends. The driveshaft housing 160 is in the midsection 36 of the outboard motor 20, below the pass-through plate 30 and below the engine 32. A supporting cradle, generally located at reference character 162, surrounds the driveshaft housing 160 and is a rigid truss-like member that is pivotably mounted to the marine vessel 22 via the transom bracket 48. An exemplary supporting cradle and transom bracket arrangement is disclosed in U.S. Pat. No. 9,969,475. As explained therein, the supporting cradle 162 has resilient mounts that resiliently support the engine 32 and driveshaft housing 160 with respect to the rigid supporting cradle 162, in particular such that vibration and other movements of the engine 32 during operation are not directly transmitted to the marine vessel 22 via the transom bracket 48, but instead are absorbed by the noted mounts of the supporting cradle 162. This is a known mounting configuration, as disclosed in U.S. Pat. No. 9,969,475, wherein the supporting cradle 162 is often referred to as an "unsprung mass" and the engine 32 and driveshaft housing 160 are referred to as a "sprung mass". The sprung mass is movable relative to the unsprung mass, with such movement being caused by for example vibration of the engine 32.

As shown in FIG. 1, the primary and secondary mufflers 62, 64 are coupled to the driveshaft housing 160, and thus move with the sprung mass. In contrast, the tertiary muffler 66 is coupled to the supporting cradle 162 and thus remains relatively stationary with the unsprung mass. As shown in FIGS. 2-4, the first and second conduits 158 166 are flexible members, for example made of rubber or any other suitable flexible material. The flexible nature of the first and second conduit 158, 166 advantageously accommodates the above-noted motion of the primary and secondary mufflers 62, 64 relative to the tertiary muffler 66, which occurs when the sprung mass moves relative to the unsprung mass, for example during normal operations of the outboard motor 20. The flexible nature of the first and second conduits 158, 166 permits said relative movement without breaking of the first and/or second conduits 158, 166 and/or without otherwise disrupting the exhaust connection provided by the first and second conduits 158, 166. In the illustrated example, the first and second conduits 158, 166 each have a bellows portion 164, which further facilitates flexing and/or other movement of the first conduit 158 during said movement of the sprung mass relative to the unsprung mass.

As mentioned herein above with reference to FIG. 2, the exhaust system 70 can include an operator input device 176 that is mechanically and/or electrically and/or otherwise communicatively coupled to and configured to control the bypass valve 170. The operator input device 176 can be configured such that, via the operator input device 176, an operator can have the ability to selectively position the bypass valve 170 into and out of the open and closed positions, and optionally the intermediate position(s). The type and configuration of the operator input device 176 can vary and the way the operator input device 176 is connected to the bypass valve 170 can vary. In certain non-limiting examples, the operator input device 176 can include one or more mechanical levers, and/or computer keypads, and/or touch screens and/or the like. The operator input device 176 can be configured to directly communicate with and control the position of the bypass valve 170 via for example a mechanical, or electronically wired or wireless communication link, an example of which is schematically shown in the drawings. In other examples, the operator input device 176 can be configured to communicate an operator input to the operator input device 176 to the computer controller 178, such as an engine control unit (ECU) that is configured to electronically control the bypass valve 170.

The controller 178 can be programmable and include a processor and a memory, which are also discussed in further detail below. The controller 178 can be located anywhere in the system and/or located remote from the system and can communicate with various components of the marine vessel via wired and/or wireless links. In certain examples, the controller 178 is an engine control unit (ECU) that is also configured to control the internal combustion engine and/or other components of the outboard marine engine. Although FIG. 2 schematically shows one controller 178, the system can include more than one controller 178. For example, the system can have a controller 178 located at or near a helm of the marine vessel 22 and can also have one or more controllers located at or near the outboard motor 20. Portions of the methods disclosed herein below can be carried out by a single controller or by several separate controllers. Each controller can have one or more control sections or control units. One having ordinary skill in the art will recognize that the controller 178 can have many different forms and is not limited to the example that is shown and described. In some examples, the controller 178 may include a computing system that includes a processing system, storage system, software, and input/output (I/O) interfaces for communicating with devices shown. As provided above, further information regarding control systems for marine vessels is also available in U.S. Pat. No. 6,273,771.

Optionally, the exhaust system 70 can include an indicator device 179 configured to indicate to the operator a current position of the bypass valve 170. The operator input device 176 and/or indicator device 179 can be located remotely from the outboard motor 20, for example at the helm of the marine vessel 22, or even remotely from the marine vessel 22. The type of indicator device 179 can vary. In certain non-limiting examples, the indicator device 179 can include a video or touch screen, and/or flashing lights, and/or the like. The indicator device 179 can be electronically controlled by the controller 178 to indicate to the operator the current position of the bypass valve 170.

Figure 8:
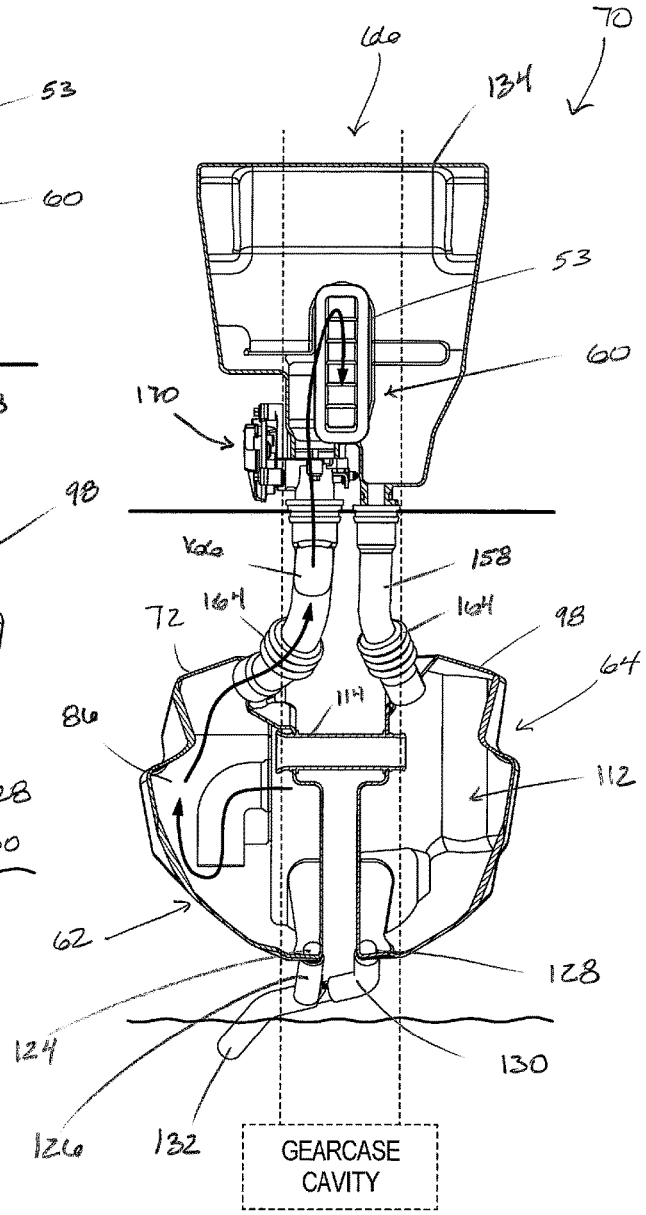
FIG. 8 depicts flow of exhaust gases through the exhaust system during the louder, sport mode, including through the primary and tertiary idle relief mufflers, but not through the secondary idle relief muffler.

Via the operator input device 176, the exemplary system shown in FIG. 2 advantageously provides the operator of the outboard motor 20 with the ability to actively control the quality and characteristics of exhaust sound emanating from the exhaust system 70. FIGS. 7 and 8 show the exhaust system 70 in two modes, including a quiet mode shown in FIG. 7 wherein the exhaust system 70 is relatively quiet, and a sport mode shown in FIG. 8 wherein the exhaust system 70 is relatively loud. The operator can change the mode of the exhaust system 70 via operation of the operator input device 176, which moves the bypass valve 170.

In FIG. 7, quiet mode, the bypass valve 170 is in the closed position so that exhaust system 70 conveys all of the exhaust gases from the primary exhaust conduit 50 to the idle relief exhaust outlet 60, in series through the primary muffler 62, the secondary muffler 64 and the tertiary muffler 66. The exhaust gasses are conveyed from the primary muffler 62 to the secondary muffler 64 via the cross-over conduit 114. The exhaust gases are conveyed from the secondary muffler 64 to the tertiary muffler 66 via the first conduit 158. The exhaust gases conveyed to the tertiary muffler 66 via the first conduit 158 are conveyed through the larger chamber 188 and then to the smaller chamber 190 via the channel 192. The above-described components can be "tuned" or in other words specifically sized and shaped to attenuate certain ranges of frequencies associated with the noted exhaust noise.

In FIG. 8, sport mode, the bypass valve 170 is in the open position so that the exhaust system 70 permits bypass flow of at least some of the exhaust gases from the primary muffler 62 to the tertiary muffler 66 without passing through the secondary muffler 64. Depending on system pressures, a portion of the exhaust gases can also flow from the primary muffler 62 to the secondary muffler 64 and then the tertiary muffler 66, as described herein above regarding FIG. 7. The bypass flow of exhaust gases is introduced into the smaller chamber 190 and then to the idle relief exhaust outlet 60 without passing through the larger chamber 188.

It should be noted that while the illustrated embodiments depict three mufflers, the exhaust system could instead be formed with four or more mufflers, including arrangements wherein the tertiary muffler provides the large chamber and a fourth muffler provides the smaller chamber.

Advantageously the three-or-more muffler arrangement provides enhanced noise attenuation, particularly in applications wherein muffler volume is overly constrained by available space within the outboard motor. In the illustrated example, the tertiary muffler 66 provides an integrated multiple-chamber configuration that permits enhanced sound tuning refinement for the noted quiet and sport modes. Location of the tertiary muffler 66 in the powerhead compartment 26 above the pass-through plate 30 reduces noise performance variations compared to systems wherein the entire sound-reducing exhaust system is located below the pass-through plate and at least partially underwater.

Figure 9:
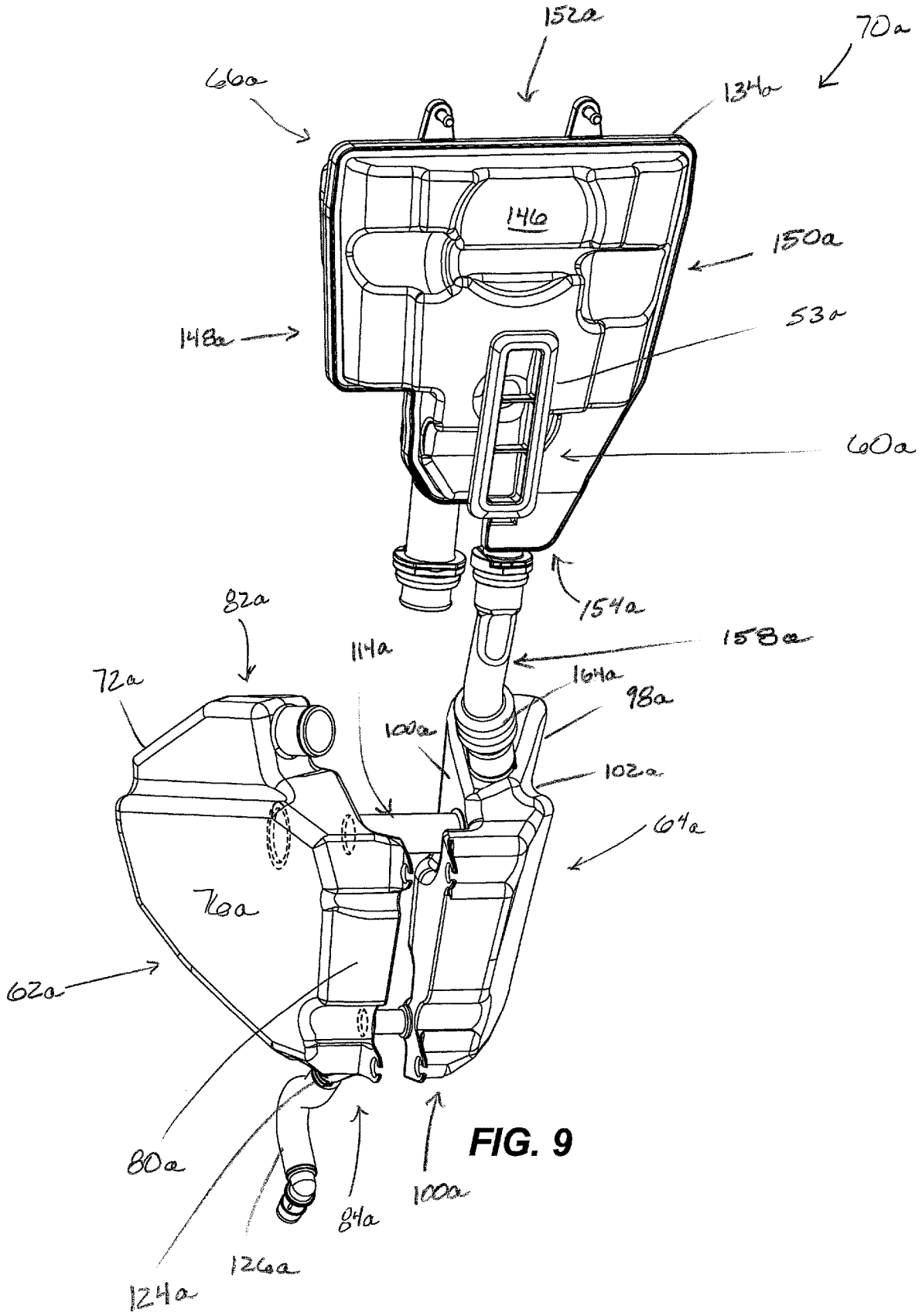
FIG. 9 is a perspective view of an alternate embodiment of the exhaust system for the marine drive.
Figure 10:
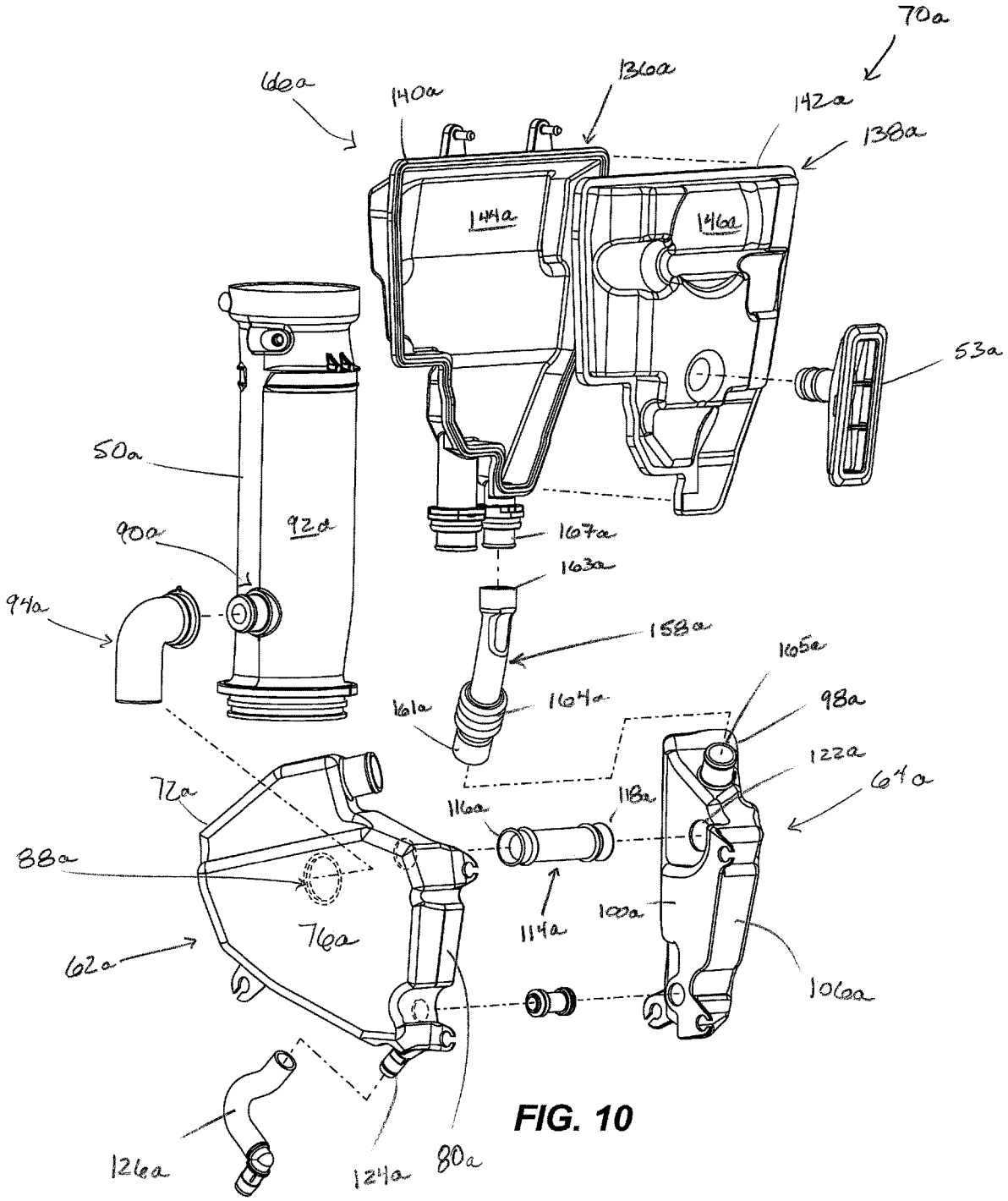
FIG. 10 is an exploded view of the exhaust system shown in in FIG. 9.
Figure 11:
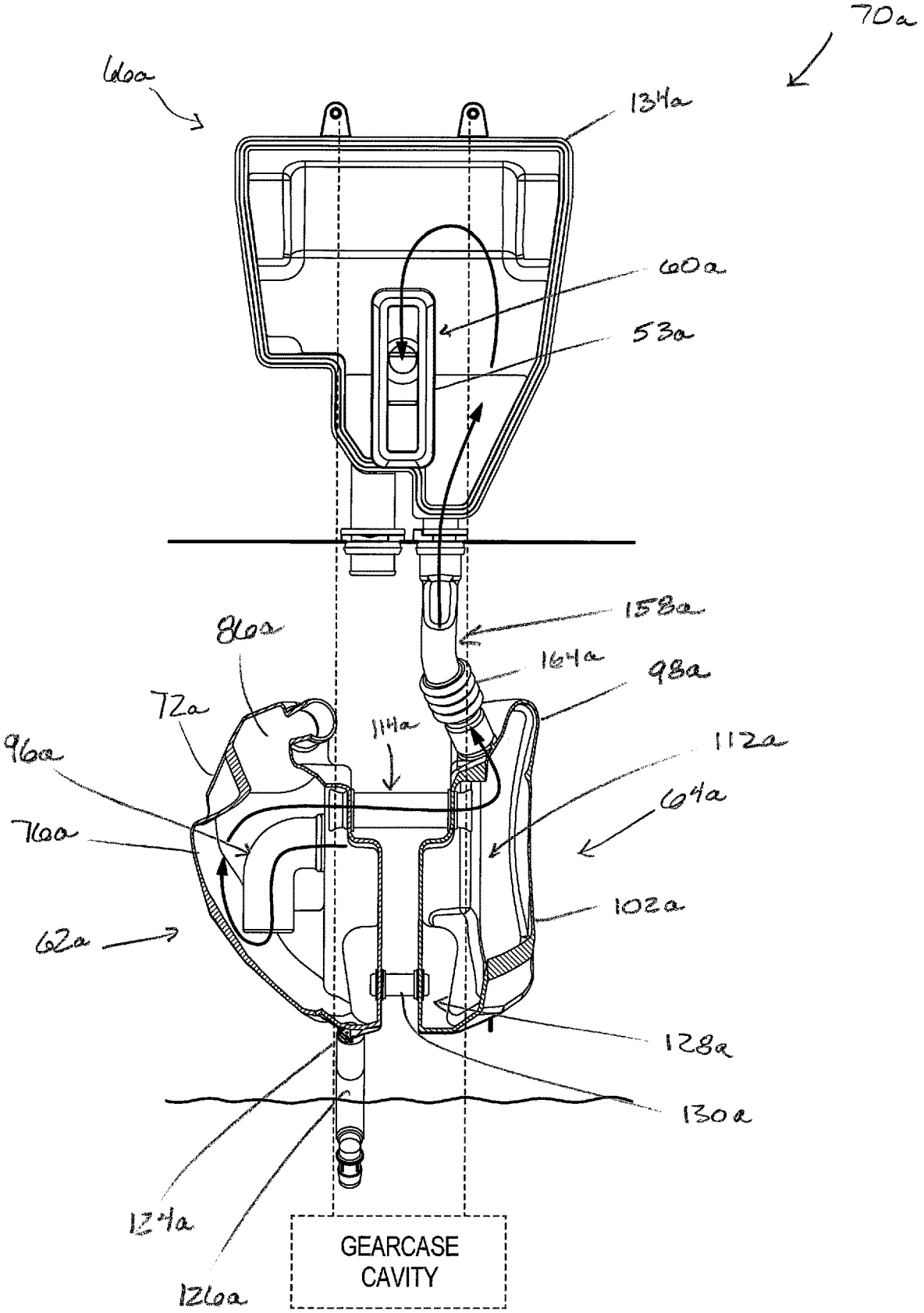
FIG. 11 depicts flow of exhaust gases through the exhaust system shown in FIG. 9.

FIGS. 9-11 depict an alternate embodiment of the exhaust system, having the reference number 70*a*. Like reference numbers have the denotation "a" are used for the alternate embodiment. The alternate embodiment differs from the primary embodiment, in that it omits the second (bypass) conduit 166 and bypass valve 170. The location of through-bore 169 in the primary embodiment is closed, for example skinned over. As shown in FIG. 11, all exhaust gases flowing through the exhaust system 70 flow in series through the primary, secondary and tertiary mufflers 62*a*, 64*a*, 66*a*. The tertiary muffler 66*a* also omits the internal wall 180 and thus omits the small chamber 190. Further, the secondary muffler 64*a* has a secondary drain 128*a* that comprises a cross-over drain conduit 130*a* draining water from the secondary muffler 64*a* to the primary muffler 62*a*, for gravity draining via the primary 124*a*.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A marine drive configured to propel a marine vessel in a body of water, the marine drive comprising:

an engine, a primary exhaust conduit receiving exhaust gases from the engine and discharging the exhaust gases to a primary exhaust outlet discharging the exhaust gases to the body of water, an idle relief exhaust outlet discharging a portion of the exhaust gases to atmosphere, above the body of water, a primary idle relief muffler receiving exhaust gases from the primary exhaust conduit, a secondary idle relief muffler receiving exhaust gases from the primary idle relief muffler, a tertiary idle relief muffler configured to receive exhaust gases from the secondary idle relief muffler and discharges exhaust gases to atmosphere via the idle relief exhaust outlet, and an inlet boss in the primary idle relief muffler, the inlet boss configured to redirect flow of exhaust gases towards an interior wall of the primary idle relief muffler to promote separation of water.

2. The marine drive according to claim 1, further comprising a cross-over conduit that conveys exhaust gases from the primary idle relief muffler to the secondary idle relief muffler.

3. The marine drive according to claim 2, wherein the cross-over conduit protrudes into an interior of at least one of the primary idle relief muffler and the secondary idle relief muffler to provide tuning of exhaust noises emanating from the primary idle relief muffler and/or the secondary idle relief mufflers.

4. A marine drive configured to propel a marine vessel in a body of water, the marine drive comprising:

an engine, a primary exhaust conduit receiving exhaust gases from the engine and discharging the exhaust gases to a primary exhaust outlet discharging the exhaust gases to the body of water, an idle relief exhaust outlet discharging a portion of the exhaust gases to atmosphere, above the body of water, a primary idle relief muffler receiving exhaust gases from the primary exhaust conduit, a secondary idle relief muffler receiving exhaust gases from the primary idle relief muffler, a tertiary idle relief muffler configured to receive exhaust gases from the secondary idle relief muffler and discharges exhaust gases to atmosphere via the idle relief exhaust outlet, and a conduit through which exhaust gases are conveyed from the secondary idle relief muffler to the tertiary idle relief muffler, wherein the conduit comprises a bellows.

5. The marine drive according to claim 4, wherein the tertiary idle relief muffler is coupled to a rigid supporting cradle for supporting the marine drive on a transom bracket and wherein the secondary idle relief muffler is coupled to a driveshaft housing of the marine drive that is movable relative to the rigid supporting cradle, which causes movement of the secondary idle relief muffler relative to the tertiary idle relief muffler, said movement being facilitated by the conduit being flexible.

6. A marine drive configured to propel a marine vessel in a body of water, the marine drive comprising:

an engine, a primary exhaust conduit receiving exhaust gases from the engine and discharging the exhaust gases to a primary exhaust outlet discharging the exhaust gases to the body of water, an idle relief exhaust outlet discharging a portion of the exhaust gases to atmosphere, above the body of water, a primary idle relief muffler receiving exhaust gases from the primary exhaust conduit, a secondary idle relief muffler receiving exhaust gases from the primary idle relief muffler, and a tertiary idle relief muffler configured to receive exhaust gases from the secondary idle relief muffler and discharges exhaust gases to atmosphere via the idle relief exhaust outlet, wherein the tertiary idle relief muffler comprises a large chamber that receives exhaust gases from the secondary idle relief muffler and a relatively smaller chamber via which exhaust gases are discharged to the idle relief exhaust outlet.

7. The marine drive according to claim 6, wherein the tertiary idle relief muffler further comprises an elongated channel through which exhaust gases are conveyed from the large chamber to the smaller chamber.

8. A marine drive configured to propel a marine vessel in a body of water, the marine drive comprising:

an engine, a primary exhaust conduit receiving exhaust gases from the engine and discharging the exhaust gases to a primary exhaust outlet discharging the exhaust gases to the body of water, an idle relief exhaust outlet discharging a portion of the exhaust gases to atmosphere, above the body of water, a primary idle relief muffler receiving exhaust gases from the primary exhaust conduit, a secondary idle relief muffler receiving exhaust gases from the primary idle relief muffler, a tertiary idle relief muffler configured to receive exhaust gases from the secondary idle relief muffler and discharges exhaust gases to atmosphere via the idle relief exhaust outlet, and a bypass conduit that conveys exhaust gases from the primary idle relief muffler to the tertiary idle relief muffler without traveling through the secondary idle relief muffler.

9. The marine drive according to claim 8, further comprising a bypass valve that is movable into an open position in which exhaust gases are permitted to flow through the bypass conduit and into a closed position in which exhaust gases are inhibited from flowing through the bypass conduit.

10. The marine drive according to claim 9, wherein the bypass valve is controllable by an operator of the marine drive.

11. The marine drive according to claim 9, wherein the tertiary idle relief muffler comprises a large chamber that receives exhaust gases from the secondary idle relief muffler and a relatively smaller chamber via which exhaust gases are discharged to the idle relief exhaust outlet.

12. The marine drive according to claim 11, wherein the bypass conduit conveys exhaust gases to the smaller chamber.

13. The marine drive according to claim 9, wherein moving the bypass valve into the open position initiates a sport mode for the marine drive and wherein moving the bypass valve into the closed position initiates a quiet mode in which exhaust noise produced by the marine drive is quieter than in sport mode.

14. A marine drive configured to propel a marine vessel in a body of water, the marine drive comprising:

an engine, a primary exhaust conduit receiving exhaust gases from the engine and discharging the exhaust gases to a primary exhaust outlet discharging the exhaust gases to the body of water, an idle relief exhaust outlet discharging a portion of the exhaust gases to atmosphere, above the body of water, a primary idle relief muffler receiving exhaust gases from the primary exhaust conduit, a secondary idle relief muffler receiving exhaust gases from the primary idle relief muffler, a tertiary idle relief muffler configured to receive exhaust gases from the secondary idle relief muffler and discharges exhaust gases to atmosphere via the idle relief exhaust outlet, a primary drain that drains condensation from the primary idle relief muffler, and a secondary drain that drains condensation from the secondary idle relief muffler, wherein the secondary drain drains the condensation from the secondary idle relief muffler to the primary drain via the primary idle relief muffler.

15. The marine drive according to claim 14, further comprising a conduit through which exhaust gases are conveyed from the secondary idle relief muffler to the tertiary idle relief muffler, wherein the conduit is flexible.

16. The marine drive according to claim 14, further comprising a primary drain that drains condensation from the primary idle relief muffler.

17. The marine drive according to claim 16, further comprising a secondary drain that drains condensation from the secondary idle relief muffler.

18. A marine drive configured to propel a marine vessel in a body of water, the marine drive comprising:

an engine, a primary exhaust conduit receiving exhaust gases from the engine and discharging the exhaust gases to a primary exhaust outlet discharging the exhaust gases to the body of water, an idle relief exhaust outlet discharging a portion of the exhaust gases to atmosphere, above the body of water, a primary idle relief muffler receiving exhaust gases from the primary exhaust conduit, a secondary idle relief muffler receiving exhaust gases from the primary idle relief muffler, and a tertiary idle relief muffler configured to receive exhaust gases from the secondary idle relief muffler and discharges exhaust gases to atmosphere via the idle relief exhaust outlet, wherein the marine drive is an outboard motor having a powerhead compartment and a midsection that is separate from the powerhead compartment, and wherein the primary idle relief muffler and the secondary idle relief muffler are located in the midsection and the tertiary idle relief muffler is located in the powerhead compartment.

19. An exhaust system for a marine drive having an engine that produces exhaust gases, the exhaust system comprising:

a primary exhaust conduit receiving exhaust gases from the engine and discharging the exhaust gases to a primary exhaust outlet discharging the exhaust gases to a body of water in which the marine drive is operated, an idle relief exhaust outlet discharging exhaust gases to atmosphere, above the body of water, a primary idle relief muffler receiving exhaust gases from the primary exhaust conduit, a secondary idle relief muffler receiving exhaust gases from the primary idle relief muffler, a tertiary idle relief muffler configured to receive exhaust gases from the secondary idle relief muffler and discharges exhaust gases to atmosphere via the idle relief exhaust outlet, and a bypass conduit that conveys exhaust gases from the primary idle relief muffler to the tertiary idle relief muffler without traveling through the secondary idle relief muffler.

20. The marine drive according to claim 19, further comprising a bypass valve that is movable into an open position in which exhaust gases are permitted to flow through the bypass conduit and into a closed position in which exhaust gases are inhibited from flowing through the bypass conduit.

21. The marine drive according to claim 20, wherein the bypass valve is controllable by an operator of the marine drive.

22. The marine drive according to claim 20, wherein the tertiary idle relief muffler comprises a large chamber that receives exhaust gases from the secondary idle relief muffler and a relatively smaller chamber via which exhaust gases are discharged to the idle relief exhaust outlet.

23. The marine drive according to claim 22, wherein the bypass conduit conveys exhaust gases to the smaller chamber.

24. The marine drive according to claim 20, wherein moving the bypass valve into the open position initiates a sport mode for the marine drive and wherein moving the bypass valve into the closed position initiates a quiet mode in which exhaust noise produced by the marine drive is quieter than in sport mode.

* * * * *